3/4/86 XR 4,574,230

United States Patent [19]

Masaki

[11] Patent Number: 4,574,230

[45] Date of Patent: Mar. 4, 1986

[54] PHASE-REGULATED SWITCHING CIRCUIT

[75] Inventor: Kazumi Masaki, Osaka, Japan

[73] Assignee: Ken Hayashibara, Okayama, Japan

[21] Appl. No.: 610,252

[22] Filed: May 14, 1984

[51] Int. Cl.[4] ..... G05F 1/455

[52] U.S. Cl. ..... 323/242; 323/370; 323/366

[58] Field of Search ..... 323/238, 239, 242, 245, 323/246, 321, 323, 326, 901, 902, 365, 367, 369, 370

[56] References Cited

U.S. PATENT DOCUMENTS

| | | | |
|---|---|---|---|
| 3,421,027 | 1/1969 | Maynard et al. | 323/245 |
| 3,624,455 | 11/1971 | Hillman | 323/245 |
| 4,207,516 | 6/1980 | Babcock | 323/908 |
| 4,220,910 | 9/1980 | Chiba et al. | 323/321 |
| 4,467,182 | 8/1984 | Merkel | 323/245 |

*Primary Examiner*—Peter S. Wong

*Assistant Examiner*—Judson H. Jones

*Attorney, Agent, or Firm*—Browdy and Neimark

[57] ABSTRACT

The present invention relates to a phase-regulated zero-crossover ac switching circuit. The present switching circuit comprises the components of (a) regulator having a time constant; (b) ac Wheatstone bridge connected with the regulator and amplifier, which bears in one arm a variable resistance; (c) amplifier for an unbalanced voltage generated in the Wheatstone bridge; (d) means for supplying dc energy to the regulator and amplifier; and (e) thyristor driven by the amplifier, wherein said components are connected in a manner such that said thyristor is not conducted at the moment when an ac power supply is coupled, and that the current through thyristor starts from a zero-crossover of ac sine wave and successively increases to the prescribed level within a period determined by the time constant of the regulator.

1 Claim, 8 Drawing Figures

PHASE-REGULATED SWITCHING CIRCUIT

DETAILED DESCRIPTION OF THE INVENTION

The present invention relates to a switching circuit which enables a zero-crossover switching-on of an ac circuit, e.g. incandescent lamp- or electric motor circuit, to reduce or even diminish the inflow of inrush current thereinto, and which permits the inflow of rate current into such circuit after a lapse of a prescribed time.

More particularly, the present invention relates to phase-regulated switching circuit, characterized by charging the output signal of an ac Wheatstone bridge, consisting of a capacitance, variable resistance connected to a time-constant circuit, and either resistance or a center-tapped coil connected to ac power supply, to the gate of a thyristor or a bidirectional triode thyristor; charging an ac current which comes into flow upon switching-on of an ac circuit to the variable resistance to obtain a phase-shifted ac output signal; and charging the phase-shifted ac output signal as gate signal to either type of the thyristor, whereby the magnitude of current inflow is successively increased.

The present invention will be explained with embodiments with reference to figures.

BRIEF DESCRIPTION OF THE DRAWINGS

FIG. 1 shows the fundamental operation of the present switching circuit according to the invention;

FIG. 2, the resistance-current characteristic of a photocoupler;

FIG. 3, the time course of resistance of a photocoupler;

FIG. 4, a circuit using a photocoupler as variable resistance;

FIG. 5, the waveforms under operation;

FIG. 6, the time course of circuit current;

FIG. 7, an embodiment according to the invention; and

FIG. 8, several types of variable resistances.

In FIGS. 1 to 8, R represents resistance; C, capacitance; VR, variable resistance; A, amplifier; K, bidirectional triode thyristor; S, power switch; F, regulating circuit; AC, ac power supply; P, dc power supply; Z, load; Q, photodiode; H, transformer; D, diode; L, coil; TH, thermistor; and N, heater.

Figure 1:
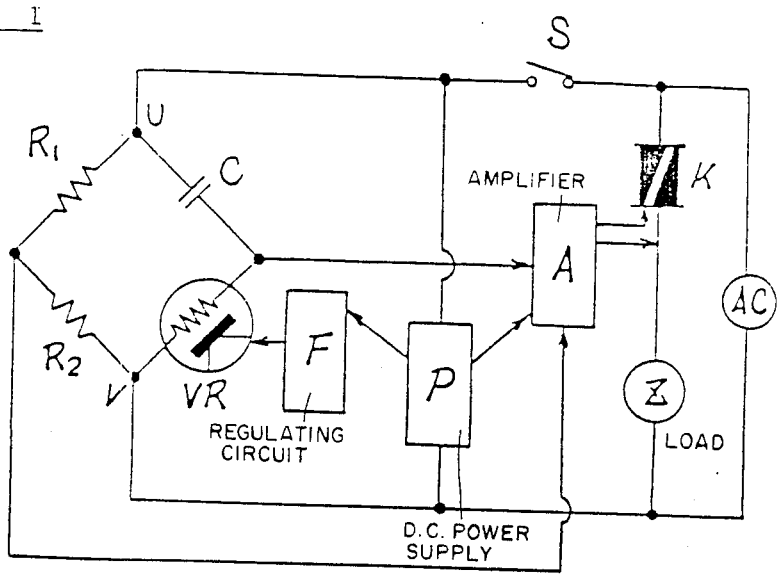
FIGS. 1 through 8 illustrate the switching circuits according to the invention.

As regards to the fundamental operation of the switching circuit according to the invention as shown in FIG. 1, amplifier A is connected to the ac Wheatstone bridge between resistances $R_1$ and $R_2$ and between capacitance C and variable resistance VR to drive bidirectional triode thyristor K with the unbalanced voltage generated in the bridge circuit.

Variable resistance VR is a thermistor or a CdS photoconductive cell whose resistance is varied by heat or light. Its resistance is in maximum or minimum level when power switch S is open, but is reversed into minimum or maximum level after a lapse of the prescribed time determined by the time consant of regulating circuit F when the power switch is closed.

When variable resistance VR is maximum or minimum in resistance, the output voltage of the Wheatstone bridge is identical in phase to the voltage of ac power supply AC at terminal U or V respectively. By driving thyristor SCR or bidirectional triode thyristor K with this output voltage, the gate of the thyristor is connected to ac sine wave at zero-crossover towards negative region when power switch S is switched on, and receives phase-shifted signals thereafter: thus, the thyristor is not conducted at the moment when power switch S is closed, and the magnitude of circuit current successively increases in course of time. In FIG. 1, symbols P and Z represent a dc power supply and a load respectively.

Figure 2:
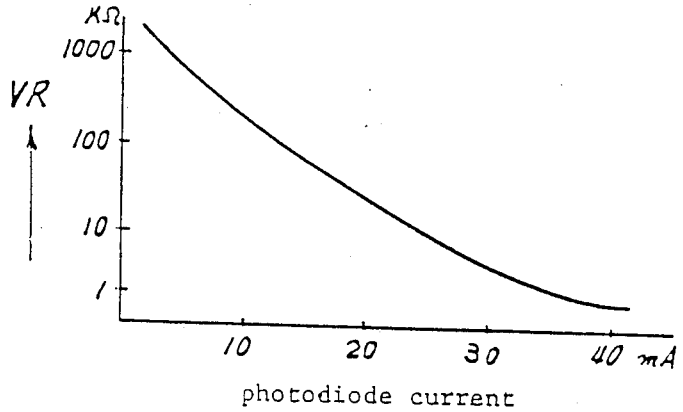
Figure 3:
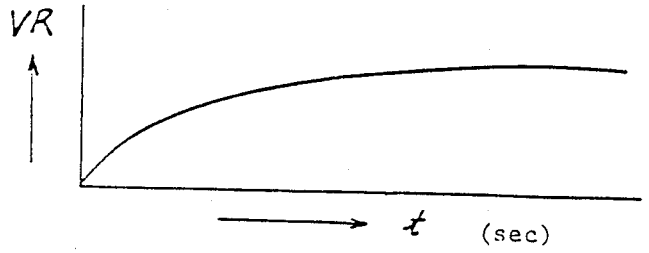

FIGS. 2 and 3 show the characteristics obtained by use of a photocoupler as variable resistance VR.

FIG. 2 shows the relation between the current through photodiode Q in the photocoupler and the resistance of the CdS photoconductive cell built in the photocoupler. This figure indicates that the resistance is 2 megohms or about 1 kiloohms when the current is zero or 40 milliamperes respectively.

FIG. 3 shows the time course of the variable resistance, indicating that the resistance reaches a constant level within a given period.

Figure 4:
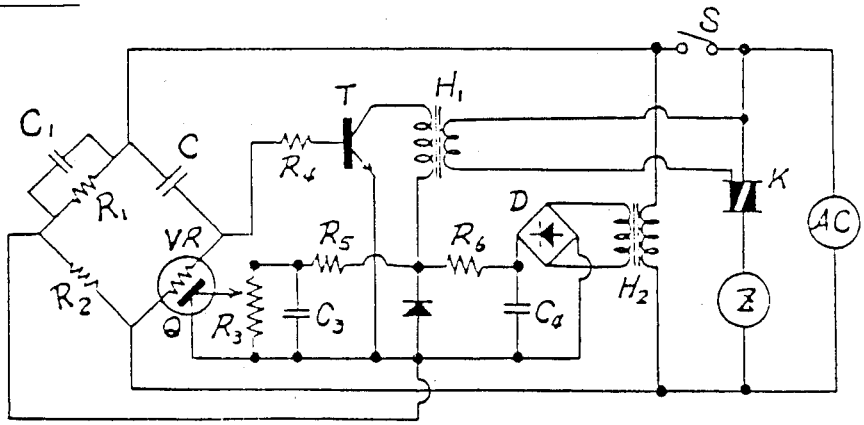

The circuit shown in FIG. 4 illustrates an embodiment using a photocoupler as variable resistance according to the invention.

Figure 5:
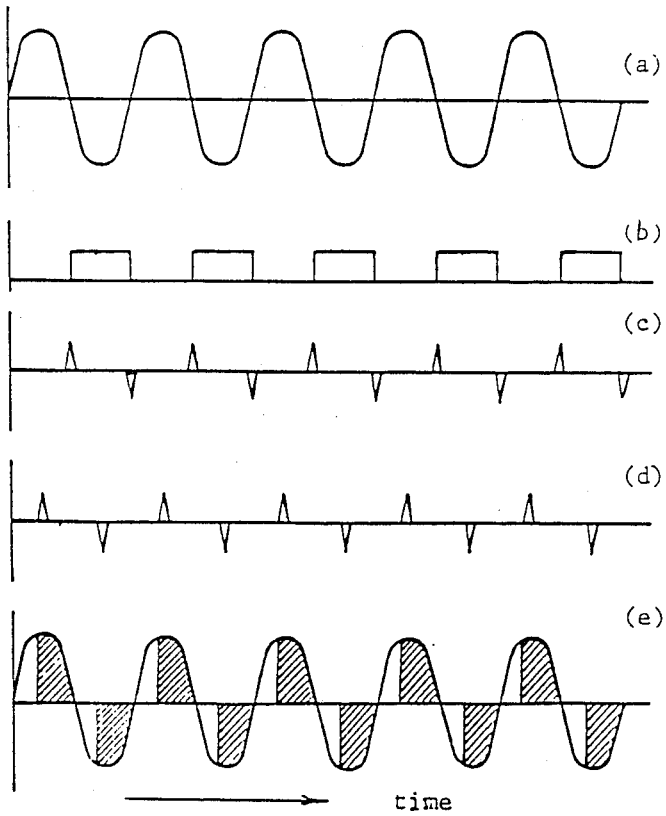

An ac Wheatstone bridge, consisting of resistances $R_1$ and $R_2$, capacitance C and variable resistance VR, is charged with an ac voltage as shown in FIG. 5(*a*). If the output voltage of the bridge is charged to the base of transistor T through resistance $R_4$ when variable resistance VR is maximum in resistance, then a voltage having a waveform as shown in FIGS. 5(*c*) generates at the secondary coil of transformer $H_1$, and the waveform of the collector current is as shown in FIG. 5(*b*).

The voltage at the secondary coil of transformer $H_1$, when charged to bidirectional triode thyristor K as gate signal, does not conduct the thyristor because its level is zero-crossover towards negative region of the ac voltage shown in FIG. 5(*a*), said ac voltage being charged to the Wheatstone bridge.

Thereafter, the current from power transformer $H_2$ comes to photodiode Q through diode D, capacitance $C_4$, resistances $R_6$, $R_5$ and $R_3$, and variable resistance VR gradually decreases in resistance. At this moment, the output pulse having a waveform as shown in FIG. 5(*d*) drives bidirectional triode thyristor K to permit the inflow of a current having a waveform as shown in FIG. 5(*e*) with oblique lines. In the circuit shown in FIG. 4, insertion of resistance $R_3$ is intended to fix the luminous intensity and current of photodiode Q at desirable levels.

Figure 6:
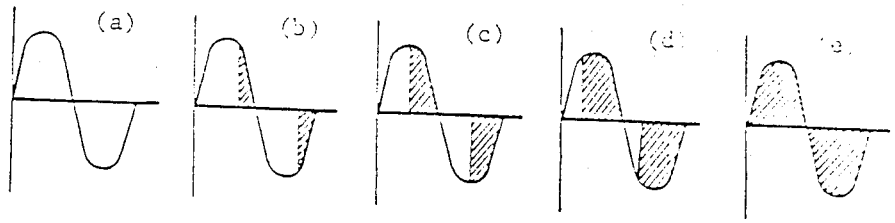

FIG. 6 shows the time course of current in the circuit shown in FIG. 4 in a period of switching-on of power switch S till a lapse of the prescribed time. At switching-on, no current comes into flow as shown in FIG. 6(*a*). In the next cycle, the circuit current increases as shown in FIGS. 6(*b*) with oblique lines; in the following two cycles, a current as shown in FIGS. 6(*c*) and 6(*d*) with oblique lines flows; and, finally, a full wave as shown in FIG. 6(*e*) comes into flow.

The time required to change the waveform as shown in FIG. 6(*a*) to that as shown in FIG. 6(*e*) may be selected in the range of several fractions of seconds to several seconds by varying such a time constant as determined by resistance $R_5$ and capacitance $C_3$ given in FIG. 4.

Figure 7:
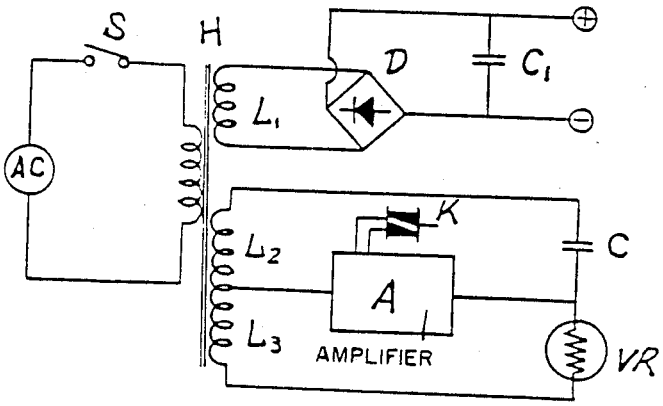

Fig. 7 shows a circuit using a step-down transformer, which is suitable when ac power supply AC is of highvoltage. In this circuit, a secondary coil $L_1$ of transformer H forms a dc power supply, and an ac Wheatstone bridge circuit is connected between another secondary coil $L_2$ and $L_3$. More particularly, by connecting the center-tap of secondary coil $L_2$ and $L_3$ to amplifier A to input the output signal between capacitance C and variable resistance VR into amplifier A, a small resistance change of variable resistance VR results in a much larger phase-shift.

Figure 8:
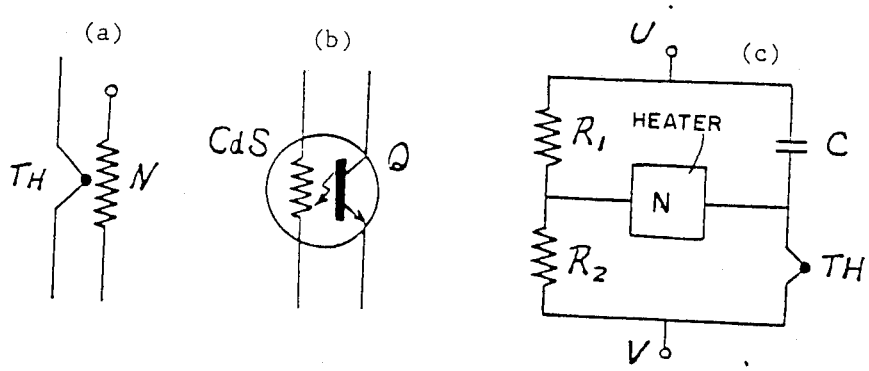

FIG. 8 shows several types of variable resistance usable in ac Wheatstone bridge: FIG. 8(*a*), a combination of heater-type thermistor TH and heater N; FIG. 8(*b*), a photocoupler using a combination of photodiode Q and a CdS photoconductive cell; and FIG. 8(*c*), a circuit which is intended to obtain a variable resistance by charging the current from capacitance C to thermistor TH to heat the thermistor per se.

I claim:

1. A phase-regulating switching circuit for ac electric equipment, essentially consisting of:

a bidirectional triode thyristor;

an amplifier connected at its output terminal to one gate of the bidirectional triode thyristor;

an ac Wheatstone bridge bearing in one arm a variable resistance comprising one of a photocoupler or a thermistor, said Wheatstone bridge being connected at one branch to the input terminal of said amplifier and at its other branch between the cathode and anode of the bidirectional triode thyristor through an ac electric equipment;

an RC phase regulating circuit having a time constant connected to the variable resistance; and means for supplying a dc energy to said amplifier and the RC phase regulating circuit.

* * * * *